United States Patent [19]

Olson et al.

[11] 4,357,808

[45] Nov. 9, 1982

[54] ICE MAKING MACHINE

[75] Inventors: John T. Olson, Albert Lea; Robert K. Westergaard, Alden, both of Minn.

[73] Assignee: King-Seeley Thermos Co., Prospect Heights, Ill.

[21] Appl. No.: 121,148

[22] Filed: Feb. 13, 1980

Related U.S. Application Data

[63] Continuation of Ser. No. 921,836, Jul. 3, 1978, abandoned.

[51] Int. Cl.[3] ..... F25C 1/04

[52] U.S. Cl. ..... 62/347; 239/246

[58] Field of Search ..... 134/176, 179–181; 239/225, 246; 62/74, 347; 248/27.1

[56] References Cited

U.S. PATENT DOCUMENTS

| | | | |
|---|---|---|---|
| 2,790,024 | 4/1957 | Fulmer | 248/27.1 X |
| 2,824,648 | 2/1958 | Bear | 134/181 X |
| 2,994,482 | 8/1961 | Valois et al. | 239/225 X |
| 3,088,474 | 5/1963 | Leslie | 134/180 X |
| 3,101,730 | 8/1963 | Harris et al. | 134/181 X |
| 3,361,361 | 1/1968 | Schutte | 134/179 X |
| 3,791,163 | 2/1974 | Dickson et al. | 62/347 |

*Primary Examiner*—William E. Tapolcai, Jr.

*Attorney, Agent, or Firm*—Harness, Dickey & Pierce

[57] ABSTRACT

An ice making machine of the type comprising a plurality of ice forming molds into which water is directed by means of a rotating spray bar supplied with water from an associated water sump or reservoir; the spray is mounted for 360° rotation about a generally horizontal axis and includes a plurality of spray nozzles which operate to not only spray water toward the ice forming molds but also toward the water reservoir to provide agitation of the make-up water contained therein so as to prevent settling of any sediment or other impurities within the make-up water.

18 Claims, 10 Drawing Figures

Fig. 5.
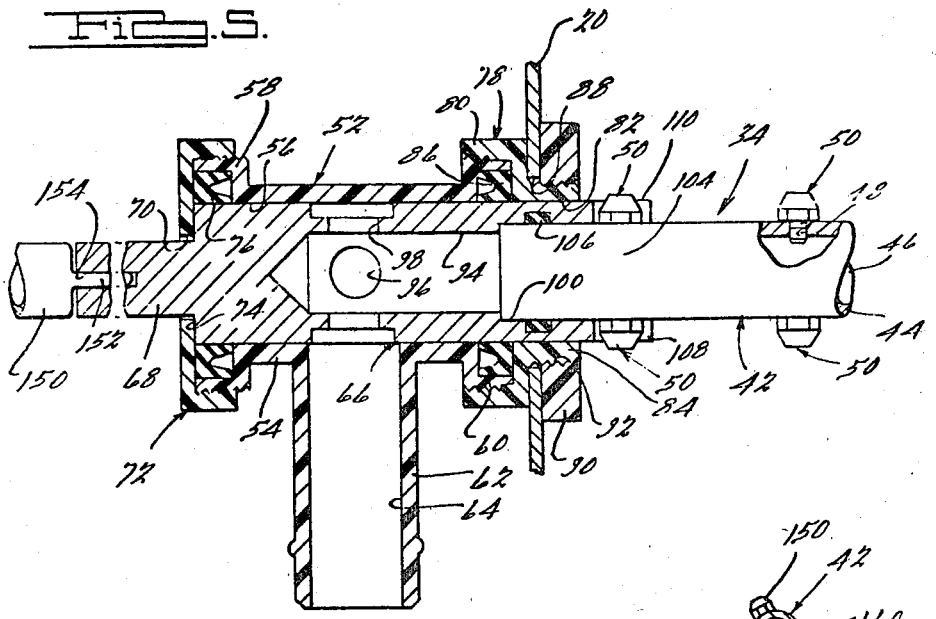
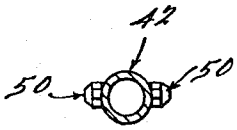
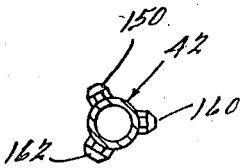
Fig. 7.
Fig. 9a. Fig. 6.
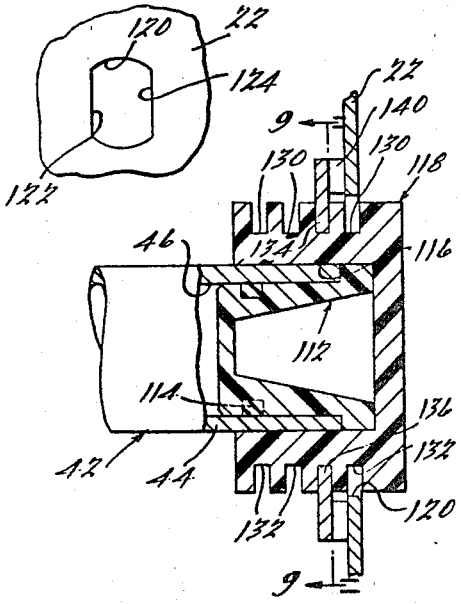
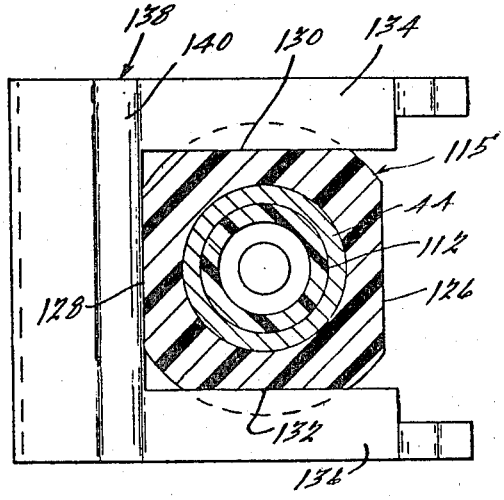
Fig. 8.
Fig. 9.

ICE MAKING MACHINE

This is a continuation of application Ser. No. 921,836, filed July 3, 1978, now abandoned.

BACKGROUND AND SUMMARY OF THE INVENTION

In U.S. Pat. Nos. 2,949,019, issued Aug. 16, 1960; 3,465,537, issued Sept. 9, 1969; 3,559,424, issued Feb. 2, 1971, and reissue Pat. No. Re. 26,101, issued Oct. 11, 1966, all of which patents are assigned to the assignee of the present application, various types of ice making machines are disclosed for producing ice cubes or the like and comprising a plurality of generally inverted ice cube cups or molds adapted to have water sprayed therewithin by means of a water spraying device. Disposed adjacent the ice cube molds is a water holding tank or platen to which water may be supplied along to supplement the hot gas defrost during the harvest portion of the operational cycle of the machine, whereby to effect release of the ice cubes which were formed within the molds during the preceding freezing portion of the cycle. The ice cubes are adapted to drop downwardly into a chute or storage bin to which access may be had through a suitable access opening or the like. After the ice cubes have thus been formed and released, the thawing water is transferred to a water sump wherein the water may be used as make-up water for the next freezing portion of the cycle.

The present invention is generally related to an ice making machine of the above-described type and features a number of improvements over the machines shown in said patents. In particular, the ice making machine of the present invention incorporates a novel spray bar arrangement wherein the spray bar is mounted for 360° rotation about a generally horizontal axis disposed between the underside of the ice cube forming molds and the upper surface of the water sump containing the make-up water for future ice batches. With this arrangement, a number of advantages are provided over various types of prior art machines, particularly insofar as simplifying the relatively complicated oscillatory drive mechanisms incorporated with oscillatory-type spray bars used in prior art machines. Another advantage provided by the 360° rotational movement of the spray bar resides in the fact that the spray bar is not only adapted to direct water upwardly toward the underside of the ice forming molds or cups, but is also adapted to spray water downwardly toward the water reservoir or sump located therebelow. Such action of the water being sprayed into the sump causes circulation or agitation of the water so as to prevent the settling of any sediment or other impurities which otherwise might tend to accumulate within the sump.

Another feature of the present invention resides in the fact that the spray bar may be provided with two or more rows of longitudinally extending spray nozzles, whereby when one row of nozzles is directing water upwardly toward the ice molds, the other row or rows of nozzles may be spraying water toward the sump, and vice versa. This particular arrangement provides yet another feature of the present invention wherein the operational life of the machine may be significantly extended. In particular, due to the normal existence of sediment and impurities within the make-up water, it is frequently the case that the spray nozzles become partially or completely clogged, resulting in a certain number of the ice forming molds not being supplied with the requisite amount of water during the ice forming cycle or operation. By providing multiple rows or nozzles on the spray bar, even though one or more of the nozzles becomes completely or partially inoperative, the other nozzle or nozzles which are generally axially aligned with the inoperative nozzle will supply the needed water during the ice forming process. Thus, service life of the ice making machine of the present invention may be considerably extended.

It is accordingly a general object of the present invention to provide a new and improved ice making machine.

It is a more particular object of the present invention to provide a new and improved ice making machine of the rotating spray bar-type, wherein the spray bar is rotational about 360° instead of being oscillatory, as in prior art designs, and thereby eliminates the need for complicated spray bar oscillating mechanisms.

It is a more particular object of the present invention to provide a new and improved spray bar-type ice making machine wherein the spray bar is rotatable 360° about a generally horizontal axis and is thereby adapted to spray water upwardly toward associated ice forming molds and downwardly toward an associated water sump to cause agitation of the make-up water within the sump.

It is a further object of the present invention to provide a rotatable spray bar-type ice making machine which includes multiple spray nozzles so as to extend the service life of the machine in the event one or more of the nozzles becomes temporarily inoperative due to clogging from water sediment, etc.

It is still another object of the present invention to provide a new and improved ice making machine of the above-described type which includes a novel means for mounting the spray bar within the machine so as to compensate for manufacturing tolerance variations.

Other objects and advantages of the present invention will become apparent from the following detailed description taken in conjunction with the accompanying drawings.

PERTINENT PRIOR ART

| U.S. Pat. Nos. | Inventor | Issued |
|---|---|---|
| 2,542,892 | Bayston | 2/20/51 |
| 2,732,690 | Henderson | 1/31/56 |
| 2,949,019 | Roberts | 8/16/60 |
| 2,677,249 | Mason | 5/04/54 |
| 2,978,882 | Bollefer | 4/11/61 |
| 3,043,117 | Bollefer | 7/10/62 |
| 3,220,214 | Cornelius | 11/30/65 |
| 3,407,621 | Dedricks et al | 10/29/68 |
| 3,465,537 | Nelson | 9/09/69 |
| 3,559,424 | Nelson | 2/02/71 |
| 3,791,163 | Dickson et al | 2/12/74 |
| 3,908,390 | Dickson et al | 9/30/75 |
| Re. 26,101 | Nelson | 10/11/66 |

BRIEF DESCRIPTION OF THE DRAWINGS

FIG. 5 is an enlarged fragmentary cross-sectional view of a portion of the drive mechanism incorporated in the ice making machine of the present invention;

FIG. 6 is a transverse cross-sectional view of the spray bar incorporated in the ice making machine of the present invention;

FIG. 7 is a view similar to FIG. 6 and illustrates a slightly modified embodiment of the present invention;

FIG. 8 is an enlarged fragmentary cross-sectional view of a portion of the support structure for the spray bar embodied in the ice making machine of the present invention;

FIG. 9 is a transverse cross-sectional view taken substantially along the line 9—9 of FIG. 8; and FIG. 9A is a fragmentary side elevational view of a portion of the end wall of the ice making mechanism of the present invention.

DESCRIPTION OF THE PREFERRED EMBODIMENTS

Figures 1, 2:
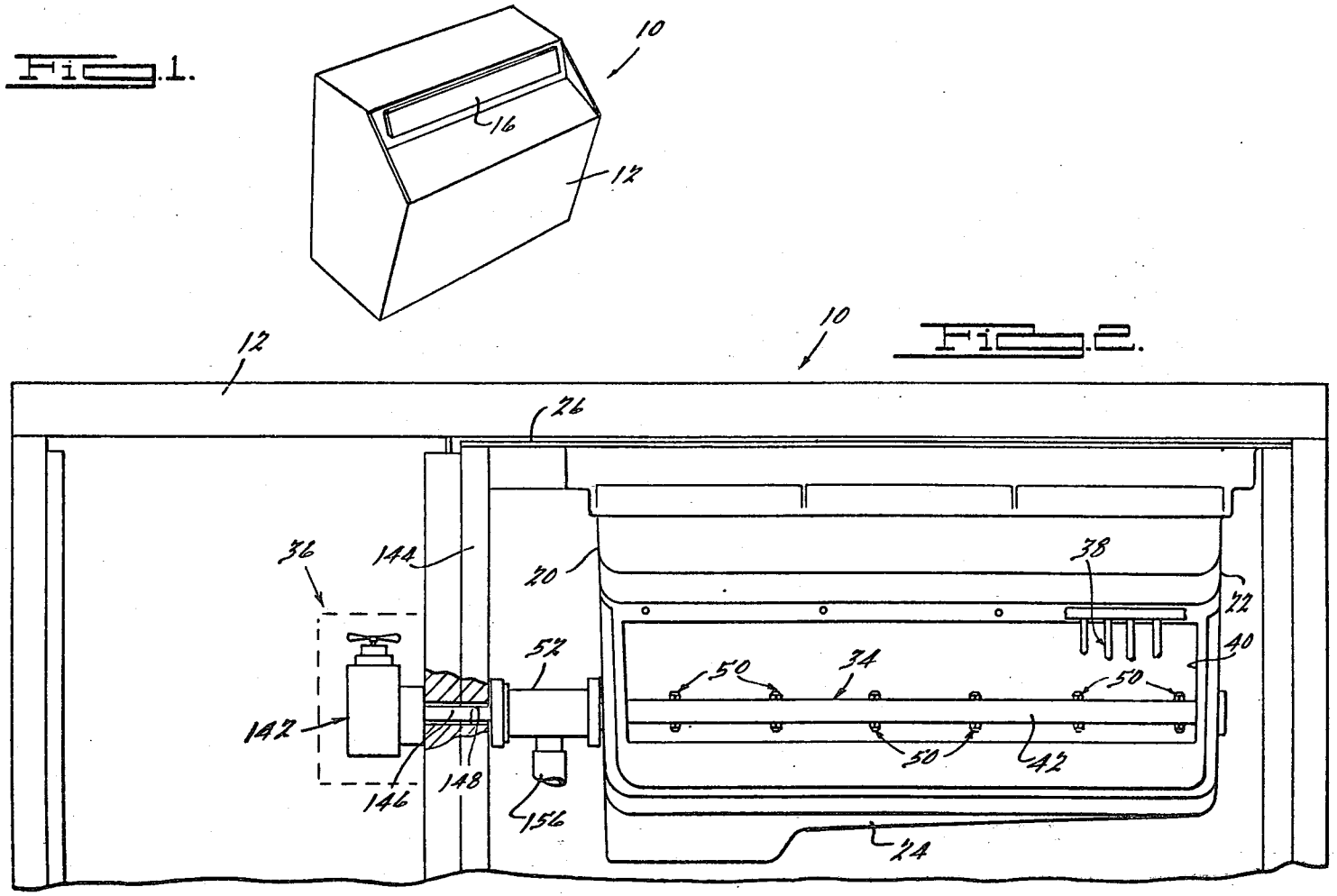
FIG. 1 is an elevated perspective view of an ice making machine embodying the principles of the present invention.
FIG. 2 is an enlarged fragmentary cross-sectional view of a portion of an ice making mechanism of the present invention.
Figure 3:
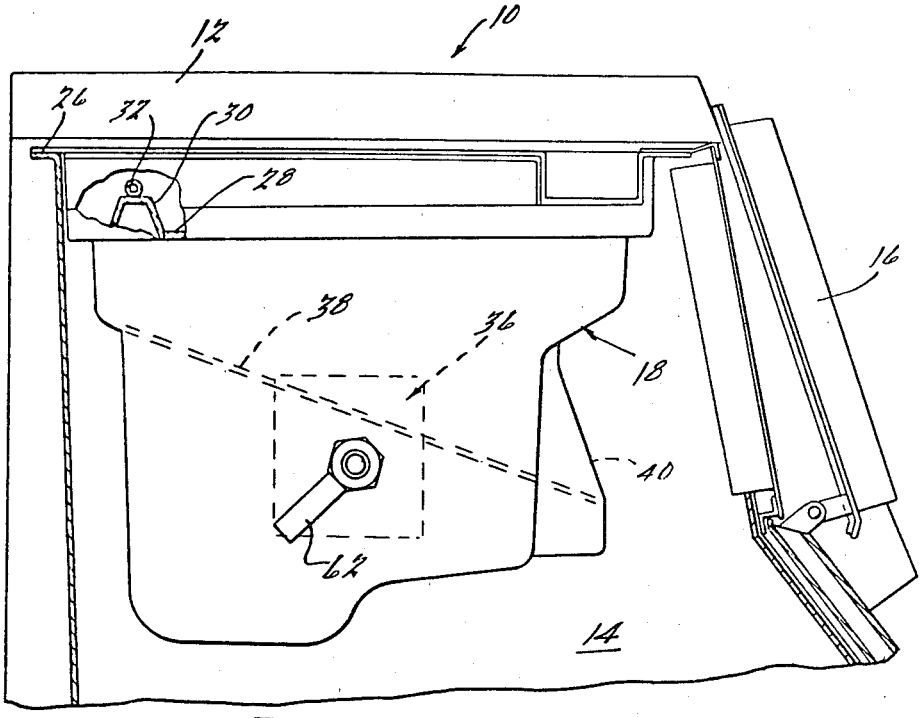
FIG. 3 is an enlarged fragmentary end elevational view of the structure shown in FIG. 2.
Figure 4:
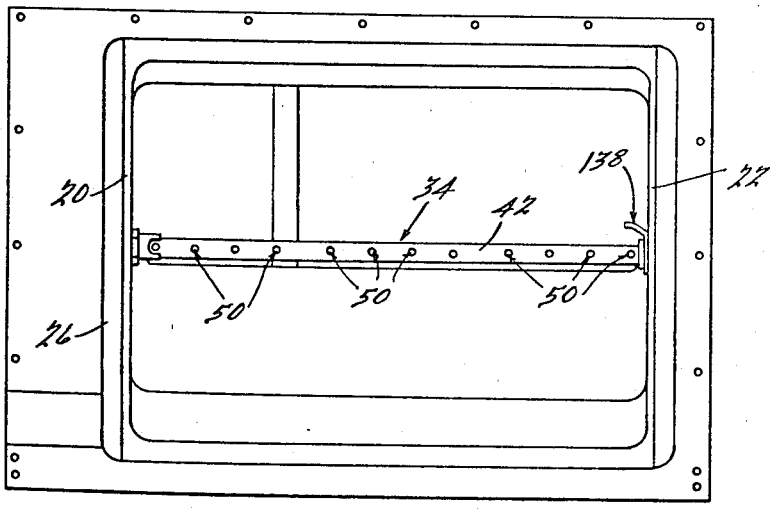
FIG. 4 is a top elevational view of the ice producing mechanism of the present invention.

Referring now in detail to the drawings and in particular to FIGS. 1 through 3, an ice making machine 10, in accordance with one preferred embodiment of the present invention, is shown generally as comprising an exterior housing or enclosure 12 within which is located an ice storage bin, generally designated by the numeral 14. The front or forward face of the housing 12 is provided with a hingedly mounted access door 16 for providing access to the interior of the storage bin in a manner well known in the art. Disposed within the interior of the housing 12 and not constituting a direct portion of the subject invention is a suitable refrigeration system (not shown), including the usual compressor, condenser, and evaporator, the latter of which is operatively associated with the ice producing mechanism of the present invention. As will be appreciated by those skilled in the art, the refrigeration system functions in a manner such that gaseous refrigerant at relatively high pressure is supplied by the compressor to the condenser, the refrigerant being cooled and liquified as it passes through the condenser. The thus cooled and liquified refrigerant then flows from the condenser to the evaporator where the refrigerant is vaporized by the transfer of heat thereto from water which is being formed into ice pursuant to the present invention. The gaseous refrigerant then flows from the evaporator back to the inlet or suction side of the compressor for recycling.

Disposed within the upper end of the housing 12 inwardly from the access door 16 is an inner housing, generally designated by the numeral 18. The housing 18 includes laterally spaced apart end walls 20 and 22, a bottom 24 and an upper peripherally extending mounting flange 26. As shown in FIG. 3, located within the upper end of the housing 18 is a platen 28 which is provided with a plurality of inverted ice forming cups, generally designated by the numeral 30. Located directly above the plurality of cups 30 is the refrigerator evaporator which consists of a length of refrigerant conduit or tubing 32 that is arranged in a generally serpentine configuration and includes a plurality of generally spaced parallel conduit sections interconnected at their opposite ends so as to provide for a continuous refrigerant flow path located in heat transfer relationship with the upper ends of the cups 30. As illustrated, the cups 30 are of a generally frusto-conical configuration, i.e. are of a generally circular shape and decrease in cross-sectional size toward the upper ends thereof, whereby ice which is formed therein may be released therefrom and drop freely downwardly away from the underside of the platen 28.

In accordance with the principles of the present invention, disposed below the plurality of inverted ice forming cups 30 is a spray bar assembly, generally designated by the numeral 34, which is adapted to spray water upwardly into the inverted cups 30. The spray bar assembly 34 is selectively operated by means of a drive mechanism, generally designated by the numeral 36, which operates in a manner hereinafter to be described in controlling the movement of the spray bar within the lower end of the inner housing 18. The ice which is formed within the plurality of cups 30 is intended to drop downwardly onto an inclined grate, representatively illustrated in FIGS. 2 and 3 by the numeral 38, whereby the ice is directed downwardly through an opening 40 in the side of the inner housing 18, from where the ice passes into the storage bin 14.

Referring now in detail to the construction and operation of the spray bar assembly 34, as best seen in FIGS. 5, 6, 8 and 9, the assembly 34 includes an elongated hollow cylindrical spray bar 42 having a tubular side wall 44 that defines an elongated central passage 46. Disposed longitudinally along the spray bar 42 are two rows of apertures, generally designated by the numeral 38, which are arranged diametrically opposite one another, i.e., 180° apart around the circumference of the spray bar 42. Disposed within each of the apertures 48 is a spray nozzle, generally designated by the numeral 50, which is adapted to be threadably or otherwise suitably secured within the associated aperture 48 and adapted to direct water which is communicated through the central passage 46 radially outwardly, which sprayed water is intended to be directed both upwardly into the plurality of cups 30, and downwardly toward the ice make-up water sump or reservoir, hereinafter to be described.

In accordance with one of the principles of the present invention, the spray bar 42, together with the plurality of spray nozzles 50 thereon, is adapted to be mounted for 360° rotation about a generally horizontal axis located below the plurality of ice forming cups 30. Means for supporting the spray bar 42 for such operation includes a drive housing 52 best illustrated in FIG. 5 and including an elongated generally cylindrical body 54 which defines a cylindrical internal bore 56. The body 54 includes a pair of enlarged diameter, axially spaced externally threaded end portions 58 and 60 and a generally downwardly directed tubular inlet section 62 defining a bore 64 which is communicable at its inner end with the aforementioned bore 56. Rotatably supported within the bore 56 is a generally cylindrically shaped drive shaft 66, the outer diameter of which corresponds generally to the diameter of the bore 56, whereby the shaft 66 is relatively freely rotatable therein. The drive shaft 66 includes an outwardly extending, reduced diameter end portion 68 at the left end thereof, as viewed in FIG. 5, which is intended to extend axially outwardly through a central opening 70 formed in a threaded end cap 72 which is intended to be threadably assembled onto the enlarged diameter end portion 58 of the body 54. The inner side of the end cap 72 is adapted to engage a generally radially disposed shoulder 74 extending outwardly from the end portion 70 of the shaft 66 for preventing axially outward movement of the shaft 66 with respect to the housing 52.

Means in the form of a suitable cup-like or other appropriate seal 76 is disposed circumjacent the left end of the drive shaft 66, as viewed in FIG. 5, to prevent any water leakage through the opening 70, as will be appreciated by those skilled in the art.

Disposed at the opposite end of the body 54 from the end cap 72 is a second end cap, generally designated by the numeral 78. The end cap 78 is similar in construction to the end cap 72, and includes an internally threaded section 80 adapted to be threadably mounted upon the enlarged diameter end portion 60 of the body 54. The end cap 78 defines a central annular bore 82 and differs in construction from the end cap 72 in that cap 78 comprises an axially outwardly extending, annular externally threaded portion 84 that projects through an opening 88 formed in the end wall 20 of the inner housing 18. A suitable seal 86, such as the aforementioned cup-like seal 76, is provided circumjacent the drive shaft 66 within the end portion 60 for preventing fluid leakage between the outer periphery of the shaft 56 and the inner periphery of the bore 82. The entire assemblage consisting of the housing 52 and shaft 66 located therewithin is operatively supported upon the end wall 70 by having a retaining ring 90 provided with an internally threaded bore 92 threadably received upon the axially outwardly extending end portion 84 of the end cap 78, with the peripheral portion of the end wall 20 being clampingly secured between the ring 90 and the confronting surface of the end cap 78.

As best illustrated in FIG. 5, the drive shaft 66 is formed with an axially extending central blind bore, generally designated by the numeral 94, which is communicable at its inner end with a pair of diametrically extending crossbores 96 and 98 that are generally axially aligned with the bore 64 of the inlet section 62. The diametrically opposite ends of the crossbores 96, 98 are formed with enlarged diameter inlet counterbores 100 which are of generally the same cross-sectional size as the bore 64, as illustrated. The inlet end of the blind bore 94 is formed with an enlarged diameter counterbore 100 which generally corresponds in diameter to the outer diameter of the spray bar 42 and is intended to nestingly or telescopically receive an adjacent end portion 104 thereof, with means in the form of a suitable O-ring like seal or the like 106 being interposed between the outer periphery of the end portion 104 and the inner periphery of the counterbore 100 to provide a fluid-tight seal therebetween. The end of the drive shaft 66 confronting the spray bar 42 is formed with a pair of axially extending, diametrically opposed recesses or slots 108 and 110 within which the pair of spray nozzles 50 located adjacent the end portion 104 are nestingly received upon assembly of the spray bar 42 into the counterbore 102. As will be appreciated by those skilled in the art, the aforesaid pair of spray nozzles 50 located within the diametrically opposed recesses 108, 110 provide for driving engagement between the drive shaft 66 and the spray bar 42, whereupon rotation of the shaft 66 will result in concomitant rotation of the spray bar 42 and plurality of spray nozzles 50 thereon. It will also be appreciated that by virtue of the fact that the end portion 104 of the spray bar 42 is located within the counterbore 100, fluid communication is provided between the interior or central passage 46 of the spray bar 42 and the bore 94 and hence between the plurality of nozzles 50 and the inlet bore 64 via the plurality of crossbores or passages 96, 98. Therefore, the assemblage consisting of the drive housing 52 and drive shaft 66 not only provides for journal support of the adjacent end of the spray bar 42, but also provides a rotatable union for fluid communication into the interior passage 46 thereof.

Referring now to the means for operatively supporting the opposite end of the spray bar 42 from the end portion 104 thereof, as best seen in FIGS. 8 and 9, the said opposite end of the spray bar 42 is provided with an internal closure plug 112 having suitable sealing means 114 which closes the end of the passage 46. The end portion of the spray bar 42 within which the plug 112 is located is intended to be operatively received within a blind bore 116 formed in an end fitting, best shown in FIGS. 8 and 9 and generally designated by the numeral 118. The end fitting 118 is adapted to be operatively located within an opening 120 formed in the end wall 22 of the inner housing 18 and located generally horizontally opposite the opening 88 formed in the end wall 20, whereby the spray bar 42, when extending between the openings 88 and 120, will assume a generally horizontal orientation within the housing 18. As best seen in FIG. 9A, the opening 120 is generally circular in cross section, with the exception of a pair of generally diametrically opposed flats or facets 122 and 124 which correspond to a pair of flat surfaces 126 and 128 formed on the diametrically opposite sides of the end fitting 118, with the result that the outer peripheral shape of the end fitting 118 is substantially identical to the shape and cross-sectional size of the opening 120 and whereupon insertion of the end fitting 118 into the opening 120 in the position shown in FIG. 8, the flats 122, 124 and 126, 128 prevent relative rotation of the end fitting 118 within the opening 120. In a preferred construction of the present invention, the end fitting 118 is fabricated of a suitable polymeric material, such as Delrin, which has the requisite sanitary characteristics and provides for a low friction surface within the bore 116 thereof so that the adjacent end of the spray bar 42 will be journal supported, i.e. free to rotate relative to the end fitting 118 with a minimum amount of frictional resistance being created between the outer periphery of the spray bar 42 and inner periphery of the blind bore 116.

As illustrated in FIGS. 8 and 9, the outer periphery of the end fitting 118 is formed with a plurality of diametrically opposed pairs of peripheral recesses 130 and 132 which are spaced axially along the end fitting 118 and are offset generally 90° from the aforementioned flats 126, 128 formed along the sides of the end fitting 118. The pairs of peripheral recesses 130, 132 are adapted to selectively receive spaced apart leg sections 134 and 136 of generally U-shaped retaining clip, generally designated by the numeral 138 which, as illustrated in FIGS. 8 and 9, includes a generally arcuate-shaped retaining or bearing portion 140 adapted for engagement with the inner side of the end wall 22 of the housing 18 for limiting axial outward movement of the spray bar 42 and end fitting 118 thereon relative to the end wall 22. The provision of the plurality of opposed pairs of recesses 130, 132, instead of a single pair thereof, accommodates for tolerance variations in the lateral spacing of the end walls 20, 22 of the housing 18, whereby a single end fitting 118 and associated retaining clip 138 may be operative to install the adjacent end of the spray bar 42, regardless of whether or not minor dimensional variations exist between the end walls 20, 22 thereof.

As best seen in FIG. 2, the drive mechanism 36 includes a drive motor, generally designated by the numeral 142, which may be of any suitable construction and which is operatively mounted on a generally transversely extending partition 144 located adjacent the inner housing 18. The drive motor 142 includes a generally horizontally disposed drive shaft 146 which extends through a suitable opening 148 within the partition 144 and is drivingly connected by any suitable means to the input section 68 of the drive shaft 66. By way of example, one satisfactory method of drivingly connecting the drive shafts 146 and 66 is by means of a generally cylindrically-shaped tubular section best seen in FIG. 5 having one end thereof suitably secured to the drive shaft 46 and the opposite end thereof being flattened so as to define an outwardly extending diametrically disposed end portion 152 which is nestingly received within a suitable axially extending diametrically disposed slot or recess 154 formed in the input section 68 of the shaft 66. It will be appreciated, of course, that various alternative means may be used for drivingly connecting or coupling the drive shafts 146 and 66 without departing from the scope or fair meaning of the present invention.

In operation of the ice making machine 10 of the present invention, assuming the initial condition that the plurality of ice molds or cups 30 are empty, and that a suitable source of palatable water is communicated to the inlet section 62 of the drive housing 52, for example, by means of a suitable conduit or the like 156 illustrated in FIG. 2 which is communicable with a suitable supply of make-up water such is provided with a sump or reservoir located within the lower end of the housing 18, as is described in U.S. Pat. No. 3,908,390, and further assuming that the drive motor 142 is properly energized to effect rotation of the drive shaft 146 and hence rotation of the drive shaft 66 and spray bar 42, water supplied from the aforementioned source, via a suitable water pump or the like such as is described in the aforementioned U.S. Pat. No. 3,908,390 patent, will be directed outwardly from the spray bar 42 and specifically, from the plurality of nozzles 50 therealong and be forced upwardly into the plurality of inverted cups 30 during each revolution of the spray bar 42. At the same time that one row of nozzles 50 is spraying water upwardly into the cups 30, the diametrically opposite row of nozzles 50 will be spraying water downwardly into the make-up water sump located in the lower end of the housing 12, thereby causing circulation of the make-up water located therewithin so as to prevent sediment and the like from settling to the lower end of the sump and accumulating therein. As a result of the water being sprayed into the cups 30 and the normal operation of the refrigeration system circulating refrigerant through the evaporator conduits 32, ice will begin to form within the plurality of cups 30, within the excess water from the nozzles 50 dropping downwardly into the sump for reuse. After the freezing portion of the operational cycle has progressed a predetermined length of time which may, for example, be controlled by the temperature and pressure conditions of the evaporator in a manner well known in the art, the freezing portion of the cycle will be terminated and the harvest portion of the cycle will be initiated. Such harvesting of the ice cubes may, by way of example, be accomplished by communicating hot refrigerant gas to the evaporator and supplementing the thawing action thereof by transferring make-up water to the platen 28 which flows around the upper sides of the plurality of cups 30, whereby the outer surface of the ice formed within the cups 30 is thawed to effect release of the ice, resulting in the ice dropping downwardly upon the grate or grill 38 and traversing to the storage bin 14. If desired, the spray bar 42 may continue to rotate and be supplied with water from the aforementioned sump during the ice harvesting operation. It is to be noted that while two rows of the aforementioned nozzles 50 have been found to provide highly satisfactory operation in simultaneously supplying water into the plurality of cups 30 and providing sufficient agitation of the water within the sump located below the spray bar, it is contemplated that one or more additional rows of nozzles may be utilized on the spray bar, as is indicated in FIG. 7 wherein the spray bar 50 is provided with three rows of nozzles 158, 160 and 162 which are located at 120° spaced locations along the spray bar 50. A particularly important feature of the provision of a plurality of rows of nozzles, as opposed, for example, a single row thereof, resides in the fact that periodic maintenance of the spray bar is minimized to the extreme. The reason for this is that even though one or more of the nozzles 50 becomes clogged, for example, with sediment or other impurities within the make-up water, the remaining nozzle or nozzles located in the same axial location along the spray bar 42 will continue to supply water to those particular ice forming cups 30 which may be located above the nozzle which has thus failed. Accordingly, the urgency of replacing or servicing the particular clogged nozzle is not as great since there is in effect, a "back-up" nozzle for supplying water to the associated cups. Of course, an additional advantage of the present invention resides in the fact that water is sprayed or directed downwardly into the sump so as to maintain continuous agitation thereof to prevent the accumulation of sediment therewithin. A related advantage of the present invention resides in the fact that the rotational movement of the spray bar 42 along the generally horizontally extending axis is accomplished in an extremely straightforward manner via the drive motor 142 and the associated drive shafts, as compared to a drive mechanism which would be required to effect oscillation (vis a vis rotation) of the spray bar 42. Accordingly, the driving mechanism for the spray bar 42 may be significantly simplified as compared to oscillatory type drive mechanisms. This, of course, provides a correlative reduction in necessity for maintaining a complicated oscillating drive linkage arrangement, as has been required in the prior art.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

We claim:

1. In combination in an ice making machine, an ice forming mold, a water reservoir with an open top and disposed below said mold, a spray bar disposed for rotation about a generally horizontal axis and located vertically between said reservoir and said mold, said spray bar including at least one radially disposed spray port, and means for rotating said spray bar 360° about said horizontal axis whereby said spray port, during each revolution of said spray bar, alternately rotates to a downwardly directed position and thereby sprays water downwardly toward and into said reservoir, and rotates to an upwardly directed position and thereby sprays water upwardly toward and into said mold.

2. The invention as set forth in claim 1 wherein said spray bar is provided with a first plurality of ports located along a first radially disposed plane and a second plurality of ports located along a second radially disposed plane.

3. The invention as set forth in claim 2 wherein said first and second radially disposed planes are spaced approximately 180° about the axis of said spray bar.

4. The invention as set forth in claim 1 which includes first, second and third sets of radially disposed spray ports, said first, second and third sets of ports being located on first, second and third radially disposed planes, respectively, spaced approximately 120° apart about the axis of said spray bar.

5. The invention as set forth in claim 1 which includes a drive motor for selectively rotating said spray bar and fluid communicating means for supplying fluid from said reservoir to the interior of said spray bar.

6. The invention as set forth in claim 1 which includes a housing, a plurality of generally inverted ice forming molds disposed adjacent the upper end of said housing, a pair of end walls extending downwardly from said plurality of ice forming molds, said spray bar extending between said end walls and being supported at the opposite ends thereof by means cooperative with said end walls, said supporting means including a fluid union for supplying water from the interior of said reservoir to said spray bar regardless of the rotational position of said spray bar.

7. In combination in an ice making machine, the plurality of ice forming molds, a water reservoir having an open top and spaced from said molds, a horizontal spray bar disposed vertically between said molds and said reservoir, said spray bar including a first plurality of spray ports arranged along a first imaginary plane and a second plurality of spray ports arranged along a second imaginary plane, and means supporting said spray bar for rotation about a horizontal axis and drive means for rotating said spray bar so that during each revolution of said spray bar, said spray ports alternately direct water downwardly toward and into said reservoir and upwardly and into said molds.

8. The invention as set forth in claim 7 wherein said first and second radially disposed planes are spaced approximately 180° about the axis of said spray bar.

9. The invention as set forth in claim 7 which includes first, second and third sets of radially disposed spray ports, said first, second and third sets of ports being located on first, second and third radially disposed planes, respectively, spaced approximately 120° apart about the axis of said spray bar.

10. The invention as set forth in claim 7 which includes a drive motor for selectively rotating said spray bar and fluid communicating means for supplying fluid from said reservoir to the interior of said spray bar.

11. The invention as set forth in claim 7 which includes a housing, a plurality of generally inverted ice forming molds disposed adjacent the upper end of said housing, a pair of end walls extending downwardly from said plurality of ice forming molds, said spray bar extending between said end walls and being supported at the opposite ends thereof by means cooperative with said end walls, said supporting means including a fluid union for supplying water from the interior of said reservoir to said spray bar regardless of the rotational position of said spray bar.

12. An ice making machine comprising, a plurality of ice forming cups, means defining a water reservoir having an open top and disposed below said cups, a spray bar disposed for rotation about a horizontal rotational axis and located vertically between said reservoir and said plurality of cups, said spray bar including a first plurality of generally radially disposed spray ports located along a first imaginary plane and a second plurality of radially disposed spray ports located along a second imaginary plane, and means for rotating said spray bar 360° about said horizontal rotational axis, whereby during each revolution of said spray bar, said spray ports alternately direct water downwardly toward and into said reservoir and upwardly toward the underside of said cups.

13. The invention as set forth in claim 12 wherein said first and second radially disposed planes are spaced approximately 180° about the axis of said spray bar.

14. The invention as set forth in claim 12 which includes first, second and third sets of radially disposed spray ports, said first, second and third sets of ports being located on first, second and third radially disposed planes, respectively, spaced approximately 120° apart about the axis of said spray bar.

15. The invention as set forth in claim 12 which includes a drive motor for selectively rotating said spray bar and fluid communicating means for supplying fluid from said reservoir to the interior of said spray bar.

16. The invention as set forth in claim 12 which includes a housing, a plurality of generally inverted ice forming molds disposed adjacent the upper end of said housing, a pair of end walls extending downwardly from said plurality of ice forming molds, said spray bar extending between said end walls and being supported at the opposite ends thereof by means cooperative with said end walls, said supporting means including a fluid union for supplying water from the interior of said reservoir to said spray bar regardless of the rotational position of said spray bar.

17. The invention as set forth in claim 12 which includes a housing including a pair of spaced apart end walls and defining said reservoir at the lower end thereof, and wherein said spray bar extends between and is supported at its opposite ends adjacent said end walls, and which includes a fluid union located at one end of said spray bar for communicating water from said reservoir to the interior of said spray bar and drive means located adjacent said fluid union for effecting rotation of said spray bar, and which includes means at the opposite end of said spray bar supporting said opposite end for rotation relative to the associated of said end walls.

18. The invention as set forth in claim 17 wherein said means supporting said opposite end of said spray bar includes means for compensating for variations in the spacing between said end walls.

* * * * *